US005467069A

United States Patent [19]

Payet-Burin et al.

[11] Patent Number: 5,467,069

[45] Date of Patent: Nov. 14, 1995

[54] DEVICE FOR ADJUSTING THE TRIPPING THRESHOLD OF A MULTIPOLE CIRCUIT BREAKER

[75] Inventors: Jean-Luc Payet-Burin, Voreppe; Eric Ogier, Grenoble, both of France

[73] Assignee: Merlin Gerin, France

[21] Appl. No.: 222,225

[22] Filed: Apr. 4, 1994

[30] Foreign Application Priority Data

Apr. 16, 1993 [FR] France ..... 93 04856

[51] Int. Cl.[6] ..... H01H 75/10

[52] U.S. Cl. ..... 335/42; 335/10; 335/45; 335/176

[58] Field of Search ..... 335/38, 42, 45, 335/35, 167–176, 8–10

[56] References Cited

U.S. PATENT DOCUMENTS 3,593,234 7/1971 Charbonneau et al. .
3,767,880 10/1973 Austin .
3,831,120 8/1974 Powell et al. .
3,950,717 4/1976 Cellerini et al. ..... 335/45
4,267,539 5/1981 Guinan ..... 335/42
4,973,928 11/1990 Grunert ..... 335/38

FOREIGN PATENT DOCUMENTS 1041455 10/1953 France .
2446009 8/1980 France .

*Primary Examiner*—Lincoln Donovan
*Attorney, Agent, or Firm*—Parkhurst, Wendel & Rossi

[57] ABSTRACT

An adjustment device including a rotary knob for driving a positioning stud cooperating with a ramp of an oeprating component, and a ring equipped with means for selecting the angular position of an end-of-travel stop, designed to limit the rotational movement of the knob to determine a maximum tripping threshold. The ring is covered by a cover plate having an opening for access to the head of the fine tripping threshold adjustment knob. The diameter of the second opening is smaller than the external diameter of the ring to inhibit any modification of the position of the end-of-travel stop after the cover plate has been fitted.

9 Claims, 6 Drawing Sheets

DEVICE FOR ADJUSTING THE TRIPPING THRESHOLD OF A MULTIPOLE CIRCUIT BREAKER

BACKGROUND OF THE INVENTION

A device for adjusting the tripping threshold of an electrical switchgear device, notably a multipole circuit breaker, having an insulating case housing a latching mechanism associated with mechanical tripping means, and an electromagnetic trip device arranged in each pole to release the latching when the current exceeds a preset tripping threshold, the trip device comprising:

a magnetic circuit having a fixed core and an excitation coil, a plunger coupled to an operating component cooperating with the mechanical tripping means when the plunger is attracted against the fixed core, return means biasing the plunger to a separated position in the opposite direction from the fixed core, with interposition of an air-gap whose thickness determines said tripping threshold, means for adjusting the air-gap by means of a rotary knob for fine adjustment of the tripping threshold, and means for selecting the angular position of an end-of-travel stop designed to limit the rotational movement of the knob to determine a maximum tripping threshold.

State-of-the-art adjustment means includes an adjustment knob coupled to the plunger of the trip device by a mechanical link. A trip device of this kind is generally used to bring about instantaneous tripping of the circuit breaker following a short-circuit current. The current flowing in the excitation coil is then sufficient to cause attraction of the plunger. The adjustment knob enables the initial position of the plunger to be modified in order to reduce or increase the air-gap for adjustment of the tripping threshold. The adjustment knob is accessible at all times, which for certain applications, for example motor startup, enabled the tripping threshold to be forced above the protection value to prevent untimely tripping during the transient startup phase. After startup, the real tripping threshold was then reset to the recommended protection value. Forcedly putting the trip device out of adjustment during the transient phase inhibits tripping of the circuit breaker, which may cause damage to the loads.

SUMMARY OF THE INVENTION

The object of the invention is to achieve a reliable and precise adjustment device of the tripping threshold of a circuit breaker.

The adjustment device is characterized in that:

a positioning stud is driven by means of the rotary knob to cooperate with a ramp of the operating component, the end-of-travel stop is arranged on a protuberance of an annular ring surrounding the knob coaxially, the ring is covered, after adjustment of the end-of-travel stop, by a cover plate applied on the top panel of the case, said cover plate comprising a first opening for passage of the manual operating handle of the mechanism, and a second opening for access to the head of the fine tripping threshold adjustment knob, the diameter of the second opening being smaller than the external diameter of the ring, in such a way that fitting of the cover plate prevents any modification of the position of the end-of-travel stop.

To each adjustment step of the ring there corresponds a precise position of the end-of-travel stop enabling the upper tripping threshold to be adjusted. The knob enables fine adjustment of the tripping threshold between a minimum value and the upper threshold. Any modification of the upper threshold is inhibited after the cover plate has been fitted.

The coaxial arrangement of the knob and ring makes adjustment of the tripping threshold easier.

The knob comprises a spigot coming into engagement against the stop when the maximum threshold is reached, and a pinion cooperating with a rack of an adjustment strip.

The adjustment strip is common to all the poles, and the positioning stud of each trip device is slidingly mounted on a spindle securedly united to the magnetic circuit, and parallel to the trip bar.

To perform factory setting, the positioning stud is equipped with a screw cooperating with the ramp of the operating component to provide a tripping presetting, said screw being accessible via an orifice of the case.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DETAILED DESCRIPTION OF THE PREFERRED EMBODIMENT

Figure 1:
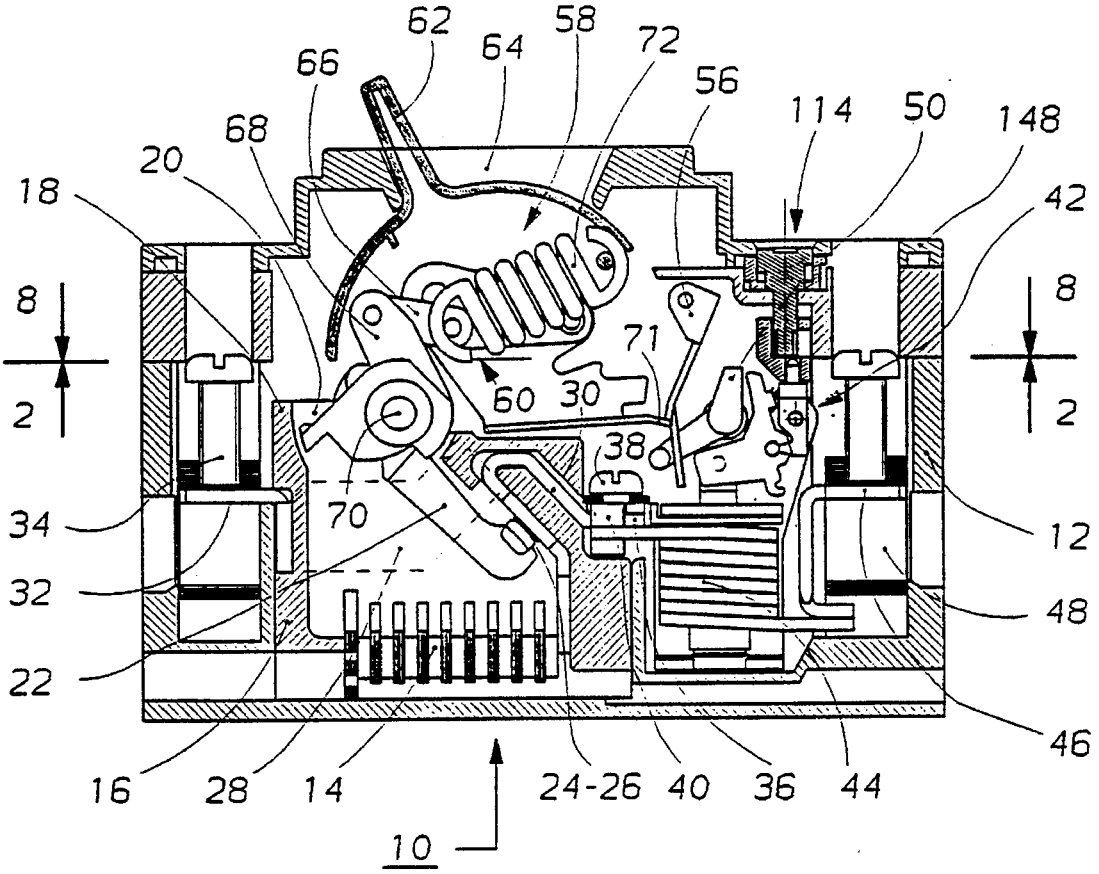
FIG. 1 is an elevational sectional view of a circuit breaker equipped with the adjustment device according to the invention, the circuit breaker being represented in the closed position.
Figure 2:
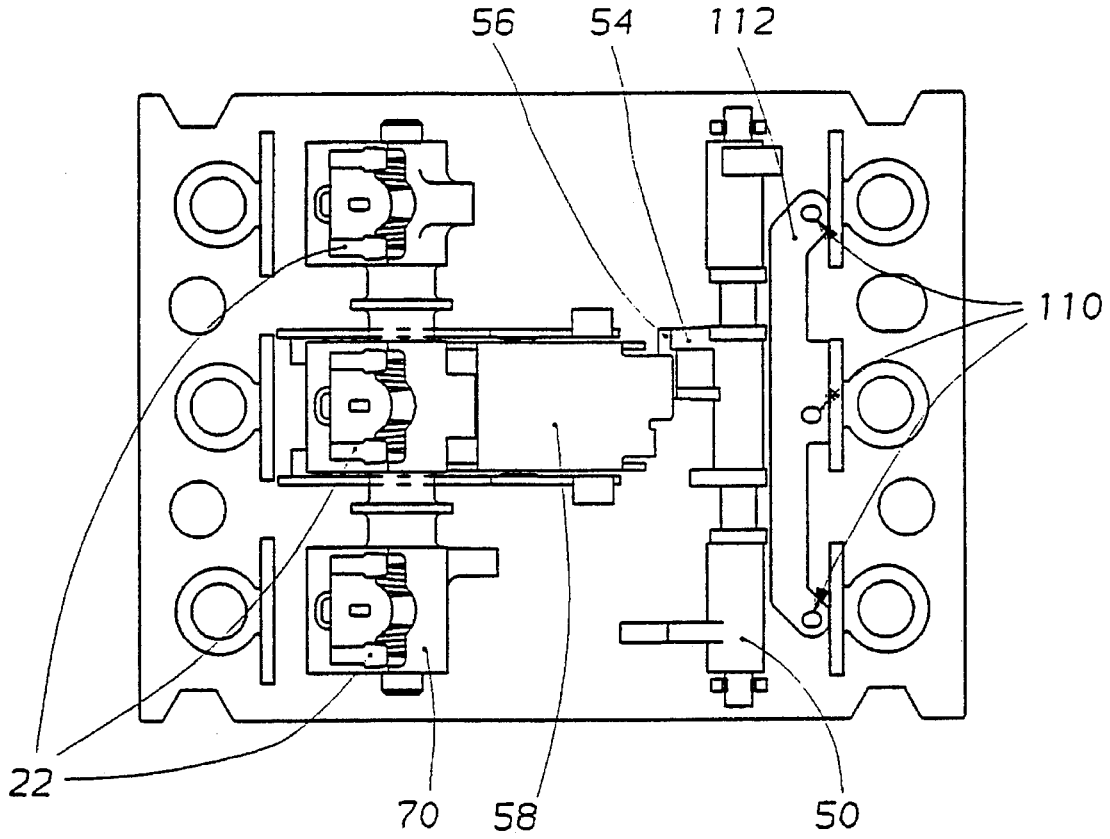
FIG. 2 is a sectional view along the line 2—2 of FIG. 1.

In FIGS. 1 and 2, a multipole circuit breaker 10 with molded insulating case 12 comprises a breaking module 14 per pole, formed by a monoblock cartridge 16 made of molded plastic material. The cartridge 16 has the shape of a parallelepiped rectangle and comprises a front panel 18 having an orifice 20 for passage of the movable contact 22.

Inside the cartridge 16 there is located a system of stationary contacts 24, 26 respectively connected by connecting conductors 28, 30 to a first contact strip 32 of a connection terminal 34, and to a second contact strip 36 designed to be connected by a screw 38 to a third contact strip 40 of a trip unit 42.

The trip unit 42 comprises an electromagnetic trip device 44 equipped opposite from the contact strip 40 with a fourth contact strip 46 forming part of the other connection terminal 48 of the pole. The trip device 44 is electrically connected in series in each pole with the contacts 22, 24, 26 of the breaking module 14.

The trip unit 42 comprises in addition a trip bar 50 made of insulating material and mounted with limited rotation between a charged position and a tripped position following the action of the operating component 52 of the trip device 44. The rotary bar 50 is moved by the component 52 to the tripped position as soon as the current flowing in the pole exceeds a preset threshold.

The trip bar 50 comprises a central protrusion 54 cooperating with a latch 56 of an operating mechanism 58 with toggle 60 and handle 62.

The mechanism 58 is common to all the poles and is housed inside the case 12, only the handle 62 being accessible from outside passing through an aperture 64 arranged in the front panel of the case 12, for manual operation of the circuit breaker 10.

The lower rod 66 of the toggle 60 is coupled to a protuberance 68 of a switching bar 70 acting as support for the movable contacts 22 of all the poles. The switching bar 70 is made of insulating material and extends parallel to the trip bar 50 in the transverse direction of the poles.

An unlocking action of the trip bar 50 on the latch 56 releases the catch 71 of the mechanism 58, the mechanism 58 being discharged due to the expansion action of a connecting spring 72, resulting in movement by pivoting of the toggle 60 and rotation of the bar 70 to the open position of the contacts 22, 24, 26 of all the poles. The order to unlock the latch 56 can come from the electromagnetic trip device 44, or from an auxiliary trip device housed in the same case 12, notably an undervoltage MN, shunt MX, or differential trip device.

Figure 3:
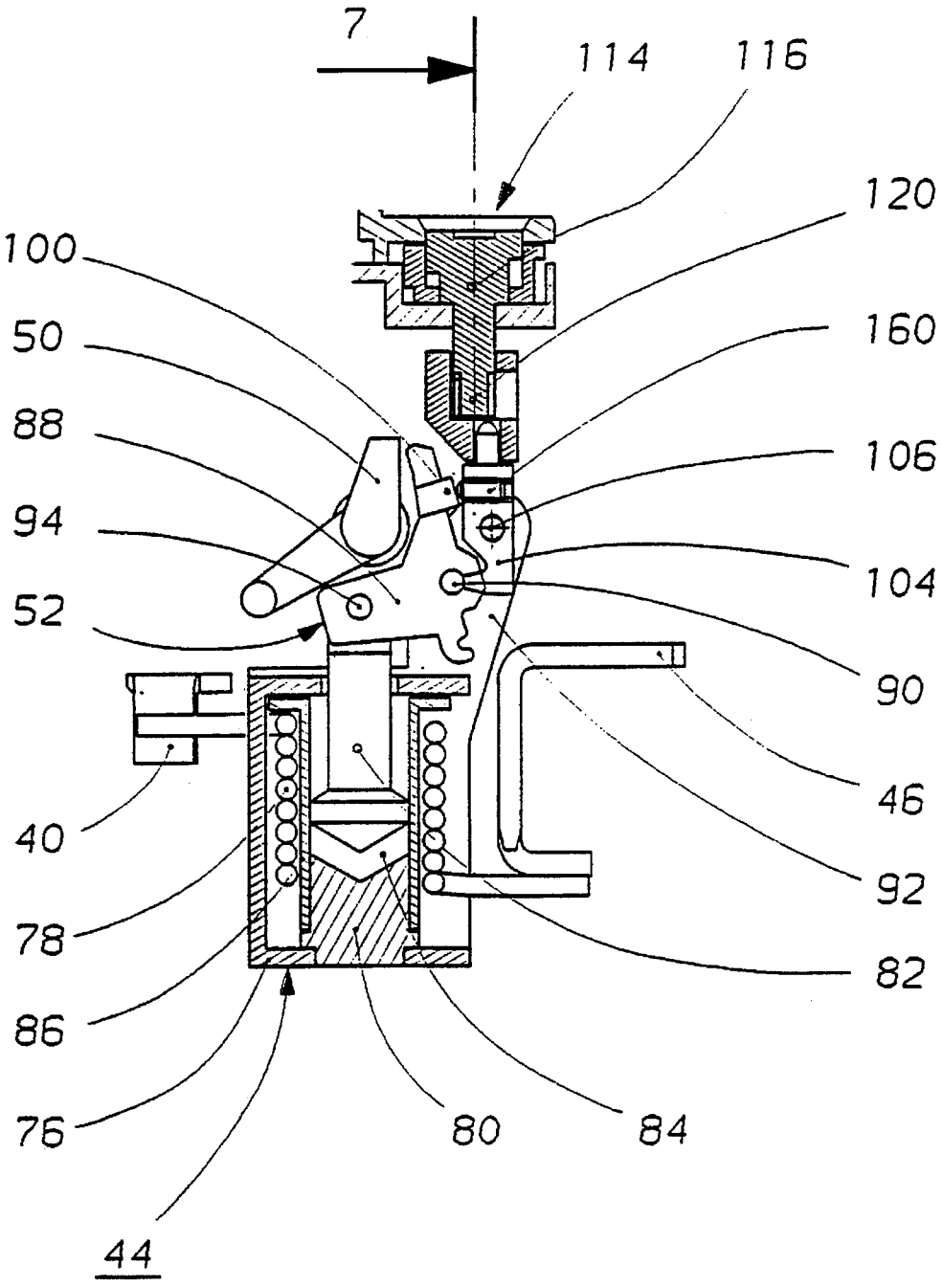
FIG. 3 is a detailed view of the trip device equipped with the adjustment device according to the invention, the circuit breaker being represented in the rest position.

Referring now to FIG. 3, the electromagnetic trip device 44 of each pole comprises a magnetic circuit or yoke 76 surrounding an excitation coil 78 of cylindrical shape electrically connected to the contact strips 40, 46. The bottom face of the yoke 76 bears a fixed core 80 penetrating axially into the coil 78 and cooperating with a mobile plunger 82 passing through the upper face of the yoke 76, the mobile plunger 82 being slidingly mounted with respect to the fixed core 80, such that an axial air-gap 84 is formed therebetween. The coil 78 is wound around a cylindrical sheath 86 made of insulating material which sheathes the assembly formed by the fixed core 80 and plunger 82. A trip device of this kind is described in the Patent FR-A-2,626,713 filed by the applicant.

Figure 8:
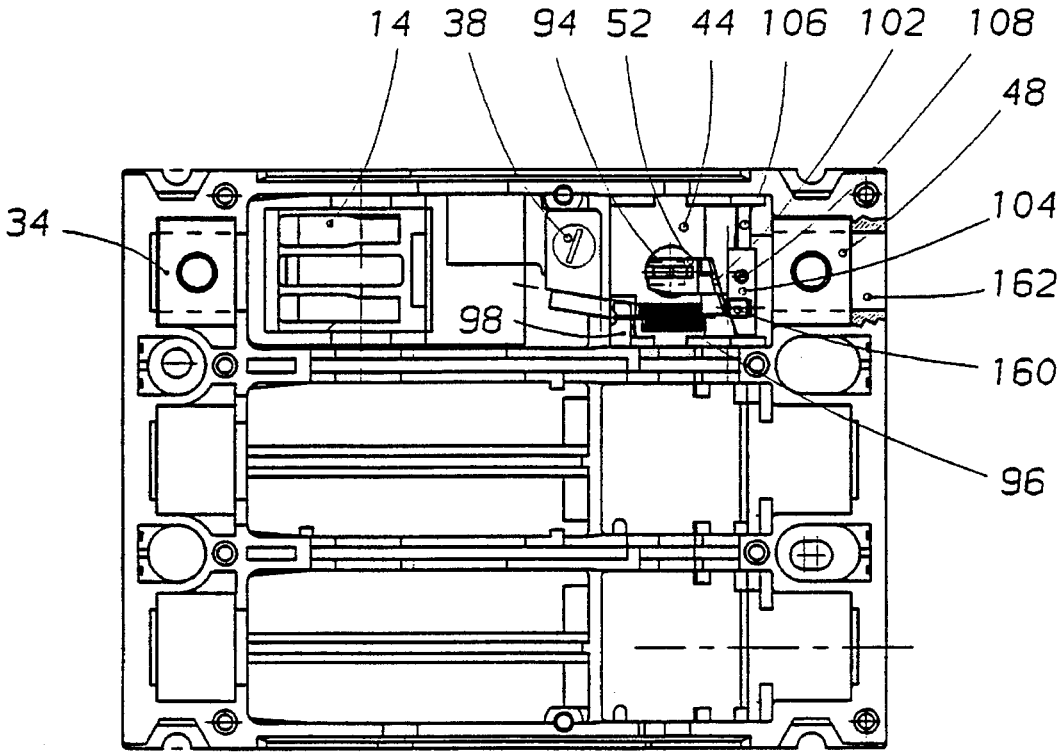
FIG. 8 is a sectional view along the line 8—8 of FIG. 1, only the trip device of the upper pole being represented.

The operating component 52 is formed by an actuating lever 88 pivotally mounted on a fixed spindle 90 supported by an extension 92 of the yoke 76. The actuating lever 88 is articulated on a spindle 94 of the plunger 82, and a return spring 96 (FIG. 8) is secured between the lever 88 and a protuberance 98 of the yoke 76, to bias the operating component 52 clockwise, corresponding to an upward movement of the plunger 82 in FIG. 3. The pivoting movement of the lever 88 is transformed into a sliding movement of the plunger 82 to perform adjustment of the air-gap 84.

Reciprocally, the sliding movement of the plunger 82 when magnetic attraction takes place against the fixed core 80 is transformed into a pivoting movement of the actuating lever 88, the lever comprising a tab 100 operating the trip bar 50.

The tab 100 of the actuating lever 88 comprises an oblique ramp 102 cooperating with a positioning stud 104 movable in translation or sliding along a fixed spindle 106 supported by the extension 92, and extending parallel above the spindle 90 of the actuating lever 88. The positioning stud 104 is equipped with a drive part 108 (FIG. 8) designed to engage in an orifice 110 of an adjustment strip 112 (FIG. 2) forming part of the adjustment device 114 of the trip device 44. The strip 112 extends parallel to the trip bar 50 and is common to all the trip devices 44 of the circuit breaker 10.

Figure 6:
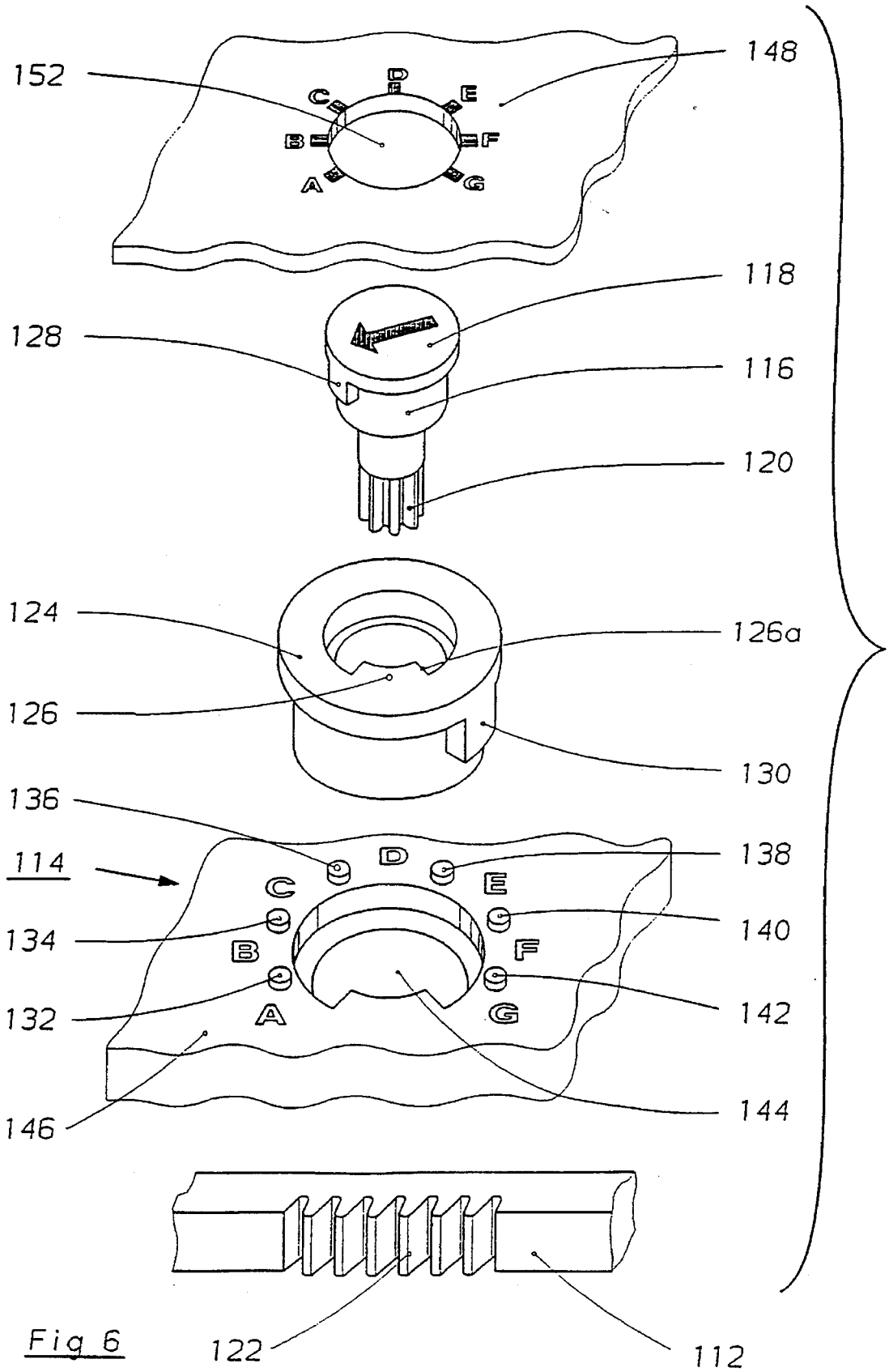
FIG. 6 is an exploded perspective view of the adjustment device of FIG. 3.
Figure 7:
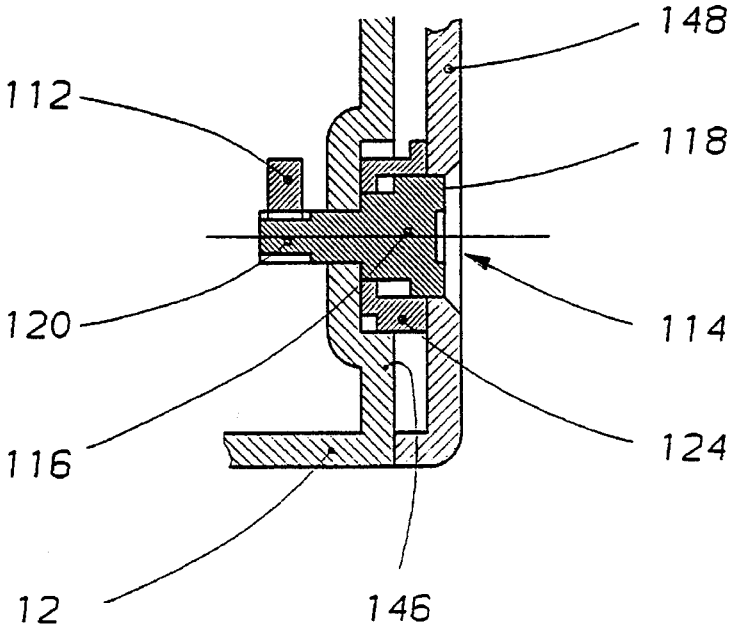
FIG. 7 is a sectional view of the adjustment device along the line 7—7 of FIG. 3.

According to the invention, the adjustment device 114 represented in detail in FIGS. 3, 6 and 7, comprises a rotary knob 116 having a head with an adjustment slot, and opposite, a pinion designed to drive a rack 122 of the adjustment strip 112 in translation. The knob 116 is housed coaxially inside an annular ring 124 provided with an internal protuberance 126 cooperating with a shoulder 128 of the knob 116 to form an end-of-travel stop **126*a*, which is adjustable according to the angular position of the ring 124**.

The lateral surface of the ring 124 is provided with at least one locking lug 130 designed to engage between consecutive pins 132, 134, 136, 138, 140, 142 angularly distributed around an aperture 144 arranged in the upper face 146 of the case 12.

A preset angular position of the end-of-travel stop **126*a* corresponds to each adjustment step of the ring 224. This angular position of the ring 124 enables the upper tripping threshold of the trip device 44 to be set to a maximum value, whereas the knob 116** enables continuous fine adjustment of the tripping threshold between a constant minimum value called low threshold and the adjustable upper threshold value.

The upper threshold is reached when the shoulder 128 of the rotary knob 116 comes into engagement against the stop **126*a* of the ring 124. The upper face 146 of the case 12 is covered by a cover plate 148 comprising a first rectangular opening 150 for passage of the handle 62 and a second circular opening 152 for access to the head 118 of the fine tripping threshold adjustment knob 116. The diameter of the second opening 152 is smaller than the external diameter of the ring 124, so that fitting of the cover plate 148 on the face 146 of the case 12 enables fine adjustment to be performed via the knob 116 from the front of the circuit breaker, but hides the ring 124** preventing any modification of the upper threshold.

The tripping threshold of the trip device 44 is indicated on the cover plate 148 by means of several markers A, B, C, D, E, F . . . (see FIGS. 4 and 6) distributed angularly around the second opening 152. Each marker corresponds to a multiple of the rated current In flowing through the circuit breaker. For example, the marker A corresponds to 6 In, the marker B to 7 In, etc. . . up to the marker G which corresponds to 12 In. To each upper threshold value there corresponds a certain position of the locking lug 130 between two consecutive pins 132 to 142 of the case 12.

For example, for the marker E corresponding to 10 In, the lug 130 of the adjustment ring 124 is inserted between the consecutive pins 138 and 140. Fine adjustment by the knob 118 then enables the tripping threshold to be adjusted between 6 In and 10 In.

Figure 4:
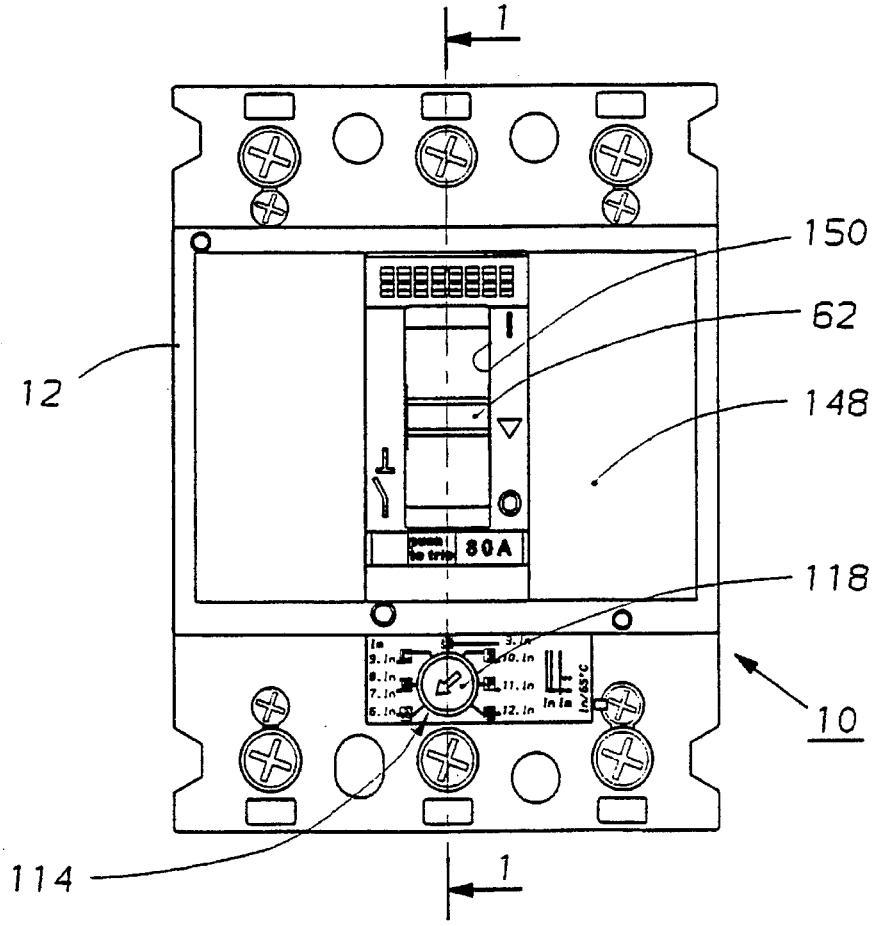

FIG. 4 shows an elevational view of the circuit breaker 10 after the cover plate 148 has been fitted and after the upper tripping threshold has been set by means of the ring 124.

Figure 5:
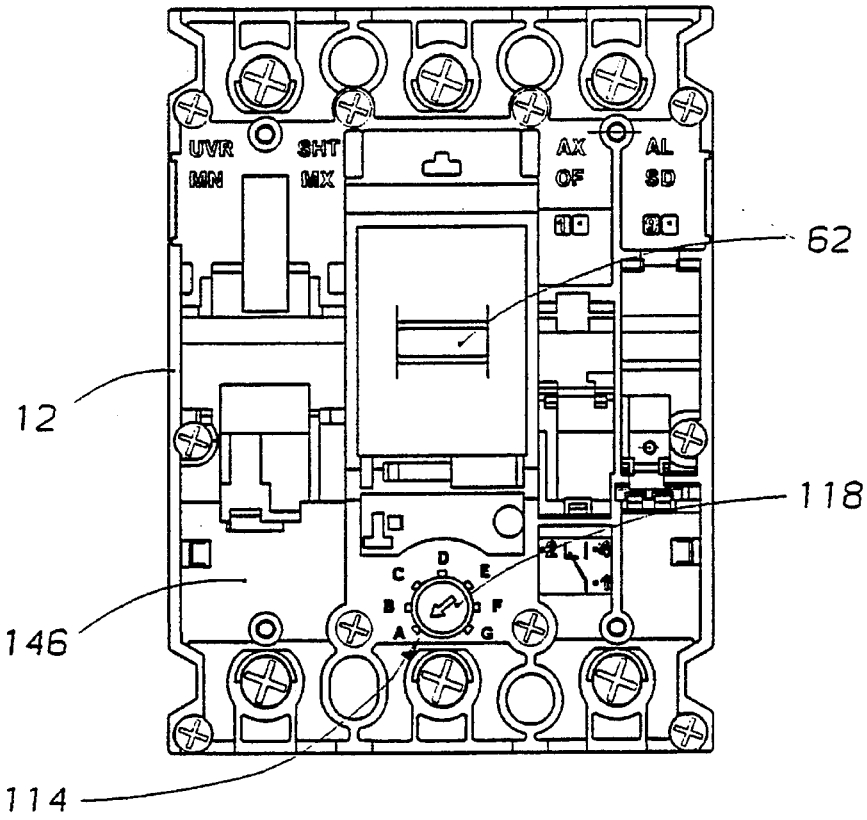
FIGS. 4 and 5 are plan views of FIG. 1, respectively after the cover plate has been fitted, and after the cover plate has been removed.

To modify the value of the upper threshold, the cover plate 148 has to be removed (FIG. 5) and the ring 124 pulled up against a return spring (not represented) to disengage the lug 130 above the corresponding pins. The adjustment ring 124 then simply has to be turned to its new position according to the required upper threshold. When adjustment of the end-of-travel stop **126*a* has been completed, the cover plate 148 can be refitted by the user, followed by fine adjustment of the tripping threshold by means of the knob 118**.

Rotation of the knob 118 causes translation of the adjustment strip 112 in a given direction with simultaneous driving of the positioning stud 104 in the same direction acting on the ramp 102 of the tab 100 of the actuating lever 88. Movement of the stud 104 in the raising direction of the ramp 102 (downwards in FIG. 8) causes counterclockwise pivoting of the actuating lever 88 (FIG. 3) followed by a depression of the plunger 82 in the direction of the fixed core 80 so as to reduce the air-gap 84. Inversely, translation movement of the stud 104 in the lowering direction of the ramp 102 (upwards in FIG. 8) causes clockwise pivoting of the actuating lever 88, and separation of the plunger 82 from the fixed core 80 with an increase of the air-gap 84.

When the current flowing in the coil 78 is lower than the tripping threshold, the plunger 82 is held in the position separated from the fixed core 80 by the action of the return spring 96. This rest state of the trip device 44 depends on the relative position of the positioning stud 104 with respect to the ramp 102, and is determined with precision by the fine adjustment of the rotary knob 116. Adjustment of the end-of-travel stop 126*a* by the ring 124 does not exert any mechanical driving action of the strip 112 and plunger 82 but merely serves the purpose of limiting the rotational movement of the knob 116 to set the upper tripping threshold.

After the trip device 44 has been set, the occurrence of a short-circuit current causes the preset tripping threshold to be exceeded, resulting in a magnetic attraction of the plunger 82 against the fixed core 80 against the return force of the spring 96. Clockwise pivoting of the actuating lever 88 drives the trip bar 50 in rotation to the tripped position, so as to release the latch 71 of the mechanism 58 for opening of the contacts.

The positioning stud 104 of each pole is equipped in addition with a screw 160 accessible via an orifice 162 of the case 12 to enable tripping presetting. The active end of the screw 160 acts directly on the ramp 102 of the actuating lever 88. Adjustment of the screw 160 constitutes a factory setting per pole, whereas the adjustment device 114 is a centralized customer adjustment common to the different poles.

It is clear that the adjustment device 114 can be used for any other type of trip device, notably with a movable blade instead of the plunger 82.

We claim:

1. A device for adjusting a tripping threshold of a multipole circuit breaker including an insulating casing having a first orifice, said device comprising:

a magnetic circuit including a fixed core and an excitation coil;

a plunger spaced apart via an air-gap from said fixed core, the air-gap defining the tripping threshold of the circuit breaker;

an operating component secured to the plunger to position the plunger with respect to the fixed core, said operating component including a ramp;

return means for biasing the plunger to be separated from the fixed core;

adjustment means for finely adjusting the air-gap between the plunger and the fixed core, including a rotary knob which drives a positioning stud along the ramp of the operating component to set the air-gap, said rotary knob extending through the first orifice in the insulating case;

setting means for setting a maximum tripping threshold of the circuit breaker, including an annular ring having a central orifice in which said rotary knob is disposed, said annular ring including a protuberance which forms an end-of-travel stop to prevent rotational movement of the rotary knob;

a top cover plate covering the insulating casing, the top cover plate including an opening over said rotary knob to allow access thereto; and preventative resetting means for preventing resetting of the maximum tripping threshold when said top cover plate is positioned on the insulating casing, wherein the opening of the top cover plate has a diameter less than a diameter of the annular ring.

2. The device of claim 1, wherein the preventative resetting means comprises a locking lug which protrudes from the annular ring, and a plurality of fixed pins spaced apart around the first orifice in the insulating casing, said locking lug being adapted to be engaged between consecutive fixed pins.

3. The device of claim 1, wherein said protuberance of said annular ring extends radially inwardly into the central orifice of said annular ring.

4. The device of claim 1, wherein the rotary knob has a shoulder which engages said end-of-travel stop defined by said protuberance of said annular ring.

5. The device of claim 1, further comprising an adjustment strip which is translated to drive the positioning stud by rotation of the rotary knob, said adjustment strip including a rack, wherein said rotary knob includes a pinion which engages said rack of the adjustment strip.

6. The device of claim 5, wherein the positioning stud is slidingly mounted on a first spindle which is parallel to said adjustment strip, said first spindle being supported by an extension of the magnetic circuit.

7. The device of claim 6, wherein said positioning stud comprises a screw which abuts the ramp of the operating component to provide tripping presetting, said screw being accessible via a second orifice in the insulating casing.

8. The device of claim 7, wherein said positioning stud further comprises a drive extension which is engaged in an orifice in the adjustment strip, and the operating component further includes an actuating lever pivotally mounted on a second spindle securely united to the magnetic circuit, said second spindle being parallel to said first spindle.

9. The device of claim 1, wherein said top cover plate includes a plurality of markers spaced apart around said opening in said top cover plate, each marker corresponding to a multiple value of rated current flowing in the circuit breaker.

* * * * *